US005437289A

United States Patent [19]

Liverance et al.

[11] Patent Number: 5,437,289

[45] Date of Patent: Aug. 1, 1995

[54] INTERACTIVE SPORTS EQUIPMENT TEACHING DEVICE

[76] Inventors: Howard L. Liverance, 25 Van Etten La., Lake Katrine, N.Y. 12449; Richard G. Spademan, 2600 Capitol Ave., Sacramento, Calif. 95816

[21] Appl. No.: 862,081

[22] Filed: Apr. 2, 1992

[51] Int. Cl.[6] ..... A61B 5/22; A61B 5/103

[52] U.S. Cl. ..... 128/779; 36/136; 36/139

[58] Field of Search ..... 128/779, 774; 73/172; 36/1, 114, 115, 116, 136, 139

[56] References Cited

U.S. PATENT DOCUMENTS

| | | | |
|---|---|---|---|
| 3,702,999 | 11/1972 | Gradisar | 36/139 |
| 4,647,918 | 3/1987 | Goforth | 128/779 |
| 4,703,445 | 10/1987 | Dassler | 364/410 |
| 4,745,930 | 5/1988 | Confer | 128/779 |
| 4,813,436 | 3/1989 | Au | 128/779 |
| 4,814,661 | 3/1989 | Ratzlaff et al. | 36/136 |

FOREIGN PATENT DOCUMENTS

| | | | |
|---|---|---|---|
| 0415036 | 3/1991 | European Pat. Off. | 128/779 |
| 2234070 | 1/1991 | United Kingdom | 128/779 |
| 1560097 | 4/1990 | U.S.S.R. | 128/779 |
| 1582034 | 7/1990 | U.S.S.R. | 128/779 |

OTHER PUBLICATIONS

Blanc et al., "An Inexpensive but Durable Foot-Switch for Telemetered Locomotion Studies" *Biotelemetry Patient Monitg* 8:4 240–245 (1981).

Miyazaki et al., "Foot-Force Measuring . . . gait", *Medical & Biological Engineering & Computing,* vol. 16 No. 4 Jul. 1978 pp. 429–436.

Johns et al., "Foot and Shoe . . . Measurements", Med. & Biol. Eng. & Comput., 1979, vol. 17 pp. 94–96.

*Primary Examiner*—Jessica J. Harrison

*Attorney, Agent, or Firm*—Townsend and Townsend Khourie and Crew

[57] ABSTRACT

A teaching device for a sports implement (3,30,75,110) is disclosed including an electro-mechanical or electronic sensing device (1,35,84,116) incorporated in the sports implement (3,30,75,110) which interacts with the thing sported (5,36,90,119) to sense the configuration or proper or improper operation of the implement during actual play and by means of a signal or alarm (27,56,106,119) provide feedback of the configuration status to the sports participant.

1 Claim, 9 Drawing Sheets

INTERACTIVE SPORTS EQUIPMENT TEACHING DEVICE

BACKGROUND OF THE INVENTION

The present invention relates to various types of sports equipment, and more particularly, equipment which is used as the means or implement for interacting with the thing sported. Many sports involve the use of equipment, without which it is impossible to participate in the sport. Common examples are tennis: where the racket is the implement, and the tennis ball is the thing sported; golf: where the club is the implement, and the golf ball is the thing sported; running: where the athletic shoe is the implement, and the support surface is the thing supported; and skiing: where the boot, binding, and ski are the implements, and the snowy slope is the thing sported. The invention can be incorporated in other sports equipment such as used in soccer and hockey.

To properly participate in any sport, a certain degree of physical and technical skill is required on the part of the participant. The physical skill, while more demanding in some sports than others, can largely be developed through exercise in working the proper muscle groups to get the body in shape for the sport. The technical skill is often much harder to develop since it requires deliberate and repetitive training and instruction in the proper use of the equipment involved in the sport. Over the years, nearly all sports have developed a set of methods which work best when operating the equipment particular to the sport. Knowledge and application of these methods helps develop the technical skill required to competitively participate in the sport.

Many participants cannot afford costly instruction by trained professionals. Instead, they try to develop the technical skill required by reading books and by trial and error. This approach to acquiring technical skill often leads to poor or inconsistent style, and is often more time consuming than undergoing formal training.

It has been shown by numerous studies that immediate feedback is the most beneficial means for learning a new technique. Several of these studies are cited here:

1. S. E. Henderson, "Role of feedback in the development and maintenance of a complex skill." Journal of Experimental Psychology 3 (1977): 224–33.
2. T. C. Simek, "Immediate auditory feedback to improve putting quickly." Perception and Motor Skills 47 (1978): 1133–34.
3. D. H. Thompson, "Immediate external feedback in the learning of golf skills." Research Quarterly 40 (1969): 589–94.

Lee Torry, in his book *Stretching the Limits—Breakthroughs in Sports Science That Create Superathletes*, states it this way:

> "Manipulation of feedback signals is one of the more promising areas in the search of methods to enhance the acquisition of motor skills. Almost all studies have found that learning rate increases as amount and accuracy of feedback increases; and performance declines dramatically when feedback is removed."

In addition, Torry states:

> "The future training technology will capitalize on the same principles of instant feedback with accurate, objective feedback." Page 203.

Formal instruction achieves this to a certain degree since the instructor watches the participant and offers advice as to what has been done wrong and what may be improved. However, an instructor's opinion may not be objective, is not necessarily reliable, and is not usually presented at the moment the technical error occurs. The use of video recording equipment is becoming more popular in the instruction of sports skills. While this form of feedback is beneficial, it is cumbersome, expensive, and not generally available to the average player.

Elaborate technology is being used to provide feedback. However, there is no personal feedback device with a system to sense the configuration of a sports participant, which allows a single player to improve his skills in a given sport. What is needed is a simple device which attaches to sports equipment that provides feedback to the player so that skill might be improved without the need for an instructor or expensive video equipment or the like.

SUMMARY OF THE INVENTION

In reference to the foregoing description, a principal object of the present invention is to provide a device with a system to sense the configuration of a sports implement during actual play and feedback the status to the sports participant.

Another object of the present invention is to provide a device with a system to sense the proper operation and interaction of a sports implement with the thing sported during actual play and feedback the status to the sports participant.

Another object of the present invention is to provide a device with a system to sense the improper operation and interaction of a sports implement with the thing sported during actual play and feedback the status to the sports participant.

In accordance with the above objects, there is provided in this application several electro-mechanical and electronic embodiments of the present invention for use with several types of sports equipment.

In one of the embodiments, there is provided an electro-mechanical assembly consisting of a weighted lever switch which bends about its pivot point and makes brief electrical contact when a moment is present about the axis of the handle of a tennis racket or golf club during impact with the tennis or golf ball.

In an electronic embodiment, a magnetic golf tee is used in conjunction with a golf ball and magnetic sensor on the golf club and an associated circuit which senses the position and angle of the club relative to the tee during a swing and reports the status of the interaction or swing relative to the tee and golf ball to the participant.

In another electro-mechanical embodiment, there is provided a plurality of pressure switches which may be activated when a foot within a sport shoe is in either forward, rearward, or transverse lean during support surface contact, indicating one or more problems with the style, gait, or manner with which the sport shoe is being used.

In still another electro-mechanical embodiment, a Microswitch$^R$ is positioned in a ski boot, or the like, which indicates the proper or improper lean of the boot during a turning maneuver relative to the snowy slope.

DESCRIPTION OF PREFERRED EMBODIMENTS

Figure 1:
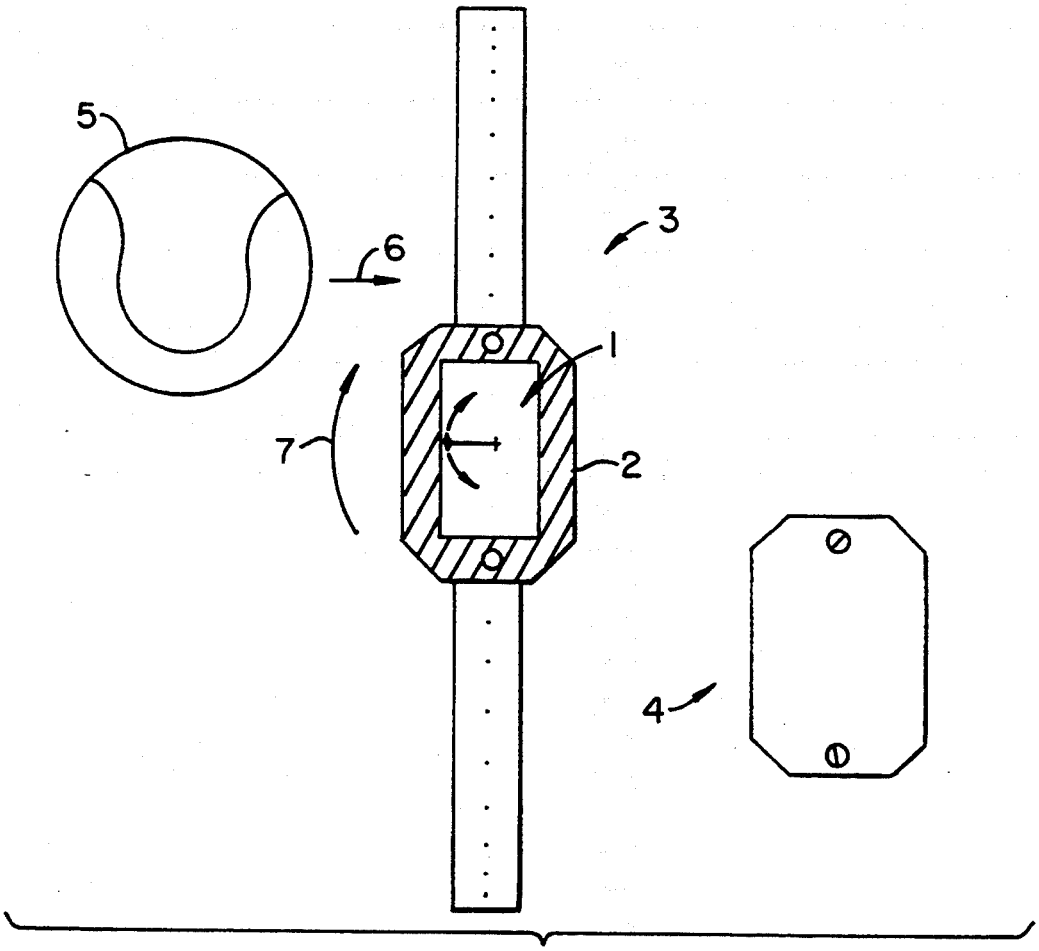
FIG. 1 is an end view of a tennis or squash or the like racket, showing the device with the cap removed. A tennis ball is shown approaching from the left.
Figure 2:
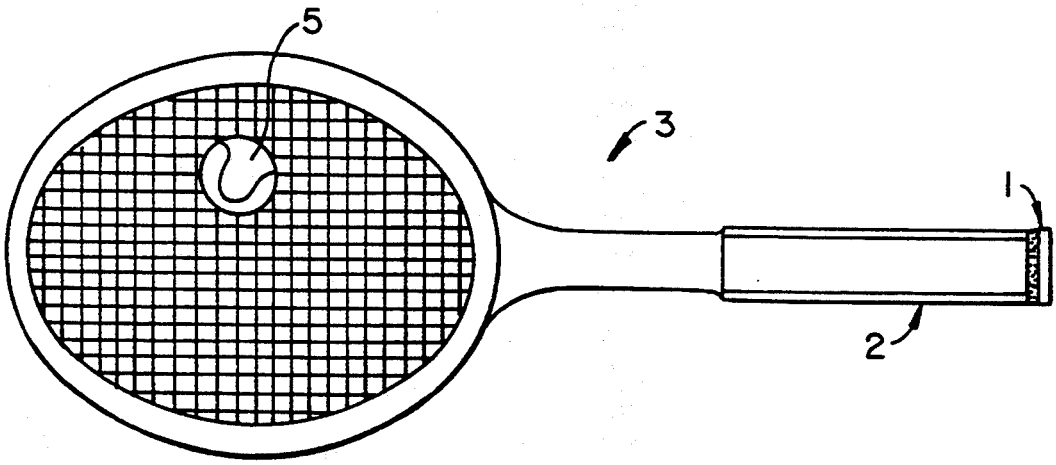
FIG. 2 is a side view of the same tennis racket with the device installed in the handle. A tennis ball is shown striking the racket in an off-center location.

Referring to FIGS. 1 and 2, there is provided in accordance with the present invention a sensing element device 1 which fits onto the handle 2 of a conventional tennis racket generally designated as 3. It is understood that the device which is being described in this embodiment has equal application to, and with proper modification could be made to work equally well with golf clubs since similar forces are present in both rackets and golf clubs. For the sake of clarity of discussion, the present embodiment is described particularly as it applies to a tennis racket.

Sensing element device 1 is shown in FIG. 1 in an end view with the cap 4 removed to expose the sensing element of the device. FIG. 2 more clearly indicates the intended location of the device on the racket. However, similar results may be obtained by locating the device of the present invention in other parts of the racket.

FIG. 1 also shows a tennis ball 5 approaching from the left in such a way as to strike the racket above the center of the string area. This is indicated by the direction of motion arrow labeled 6. The center portion of the string area is sometimes referred to as "the sweet spot". Although the sweet spot has not been well defined by the racket equipment industry, it is agreed that the ball should ideally strike the racket on a line coaxial with the axis of the handle. Factors such as Center of Percussion (CP) and Coefficient of Restitution (CDR) of the strings play an important role in determining where on the line it should impact, but the ideal hit should occur on this line. FIG. 2 shows where the ball will strike the racket in the current configuration. The axis of the handle is also indicated to point out that the ball, as shown, will strike above this axis.

Upon interaction or impact, the ball will create a moment about the axis of the racket. This is designated by the number 7 in FIG. 1. An impact by the ball below the axis of the racket will create a moment in the opposite direction from that shown in FIG. 1. A ball impacting on the axis line will create negligible moment in the direction shown.

Figure 3:
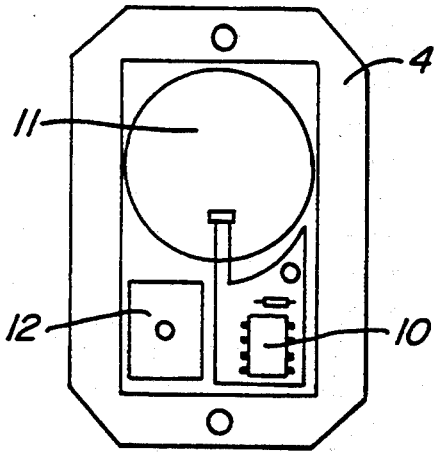
FIG. 3 is an enlarged end view of the cap of the device showing the circuitry it contains.
Figure 4:
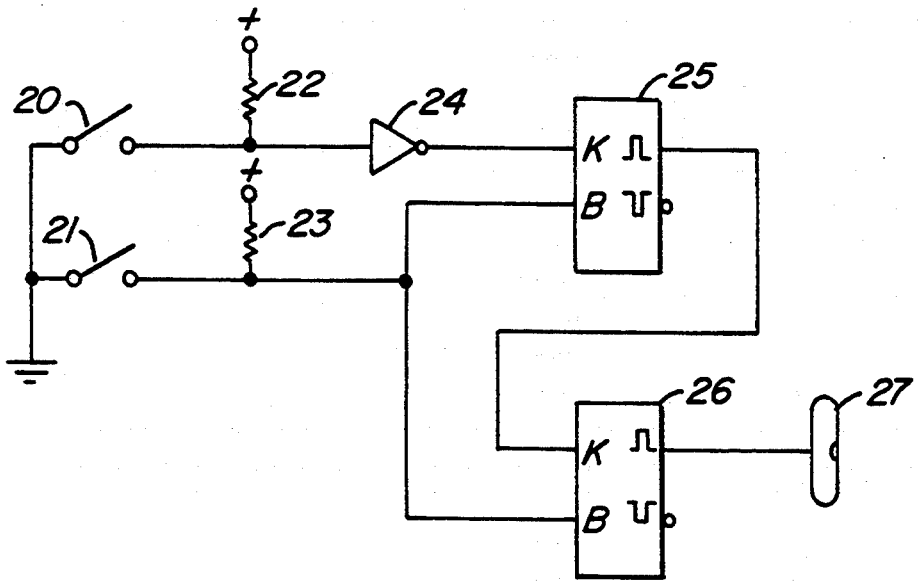
FIG. 4 is a schematic diagram of the circuit used in the first embodiment of the present invention, and shown in FIG. 1.
Figure 5:
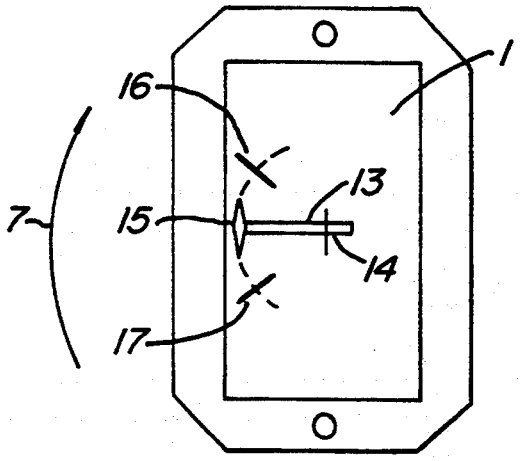
FIG. 5 is an enlarged end view of the weighted lever switch shown in FIG. 1.

Referring to FIGS. 3–5, an enlarged view of the device is shown. The sensing element device is depicted as 1, and the cap, which contains the circuitry 10, battery 11, and alarm 12, is also shown.

Sensing element 1 device consists of a metal bar 13 that is allowed to bend about a pivot point 13. At rest, bar 13 will remain in a neutral position as shown due to the natural resilience of the bar. Bar 13 is made of electrically conductive material such as copper and includes weighted end 15, to maximize the moment of inertia of the bar and thus enhance the effectiveness of the device 1. Contacts 16 and 17 are mounted adjacent to and in the line of motion of the weighted end 15 of bar 13. They are also constructed of electrically conductive material such that if bar 13 is pivoted away from its neutral position making contact with either contact 16 or 17, an electrical connection will be made. The sensitivity of the device can be altered by moving the contacts 16 and 17 either closer to or farther away from the weighted end 15 of bar 13.

When moment 7 is applied to the handle of the racket by an off-axis ball impact, the racket handle turns slightly. Since the end of bar 11 has a moment of inertia, or a tendency not to move from its current position, as the racket turns about its axis 14, bar 13 comes in contact with the contact 17 for an above-axis impact, or contact 16 for a below-axis impact and completes an electrical circuit either way. After the impact and return of the tennis ball, the moment is removed from the racket and the elastic bar 13 returns to its neutral position relative to the racket due to the resilience of the bar 13.

As stated, cap 4 contains the remainder of the circuitry needed to sound an indication that a bad hit has been made, and is designed to be placed onto the sensing element device 1 in such a way that the circuit connections are made between the members of sensing element device 1 and the electronics contained in cap 4. FIG. 4 shows a simple oscillator circuit, such as is commonly known in the art, which can be used to indicate whether a bad hit has been made above or below the center axis of the racket. The circuit consists of switches labeled 20 and 21 which refer to contacts 16 and 17 of FIG. 5 respectively; pull up resistors labeled 22 and 23; invertor labeled 24; dual input multivibrators labeled 25 and 26; and piezoelectric alarm labeled 27. As discussed previously, a moment 7 causes contact 17 to close briefly, which is equivalent to a momentary closing of switch 21. This causes the circuit to generate two short tones, indicating a ball contact above the desired location as shown in FIG. 2. A hit below the desired location generates a moment in the opposite direction causing contact 16, or switch 15*a*, to close momentarily. This causes the circuit to generate a single tone.

In addition to using multiple tones to indicate the direction off center that a bad hit is made, the device can be easily enhanced to also indicate the amount off center that the ball makes contact. The farther off center the ball strikes, the greater the moment created in the racket. A variable indication of the amount of moment can be accomplished by substituting a movable coil for contact points on bar 13, and magnets for fixed members 16 and 17. Then, when the racket moves relative to bar 13, a voltage is created which is proportional to the moment applied to the racket. This can be connected to a Voltage Controlled Oscillator (VCO) or similar circuit to give the player an indication of how far off center the hit is and allow him to compensate accordingly on the next shot.

Further, vibration sensors can be installed which detect a hit or interaction outside the "sweet spot" even though it occurs on the axis of the racket. It is expected that those accomplished in the art can provide alternate ways of accomplishing the scope and intent of this invention and that the invention is by no means limited in scope to the disclosures described herein.

The concept of the present invention may be applied to sport shoes. There are measurable parameters in footwear equipment which may be used to provide feedback to the participant and will serve to indicate good or bad form.

Figure 6:
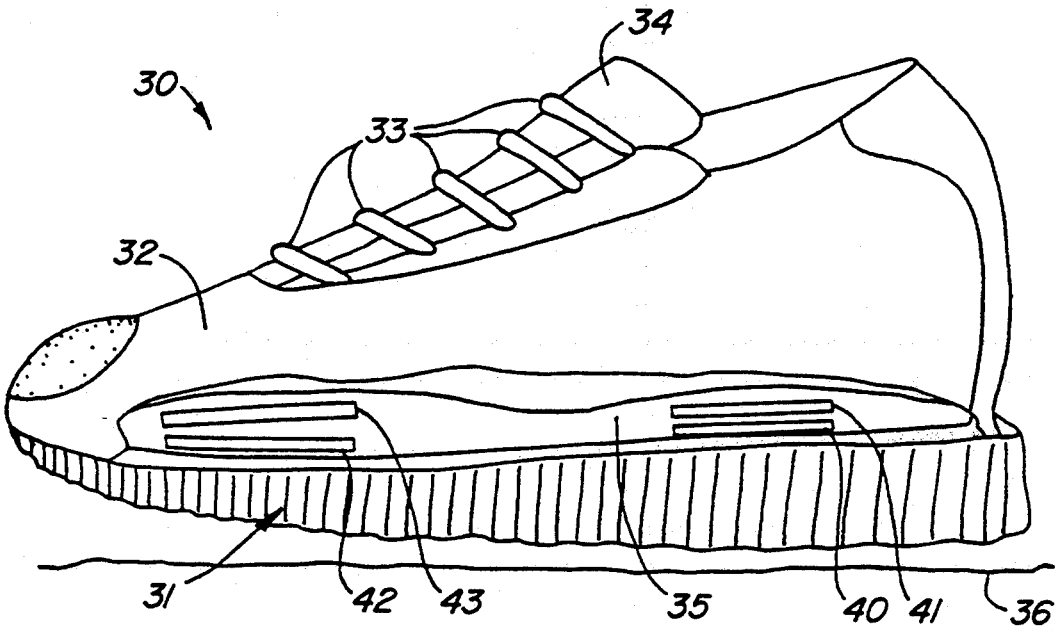
FIG. 6 is a side elevational view of a sport shoe showing the sensors for another embodiment of the device.
Figure 7:
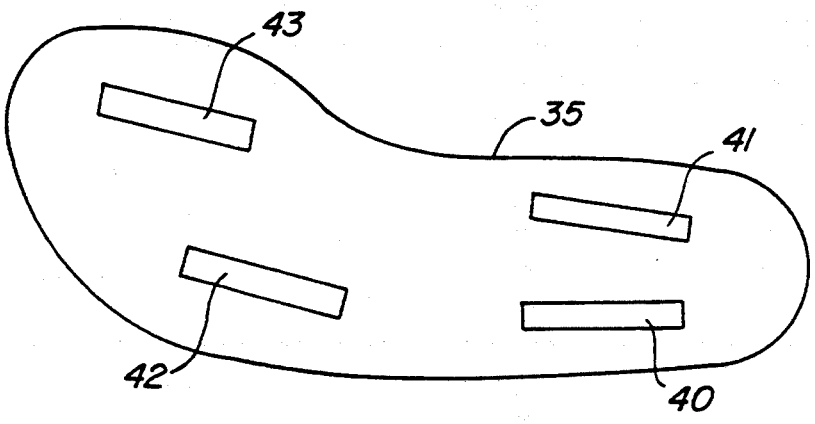
FIG. 7 is a top view of the inner sole of the same shoe shown in FIG. 6, showing the location of the sensors.
Figure 8:
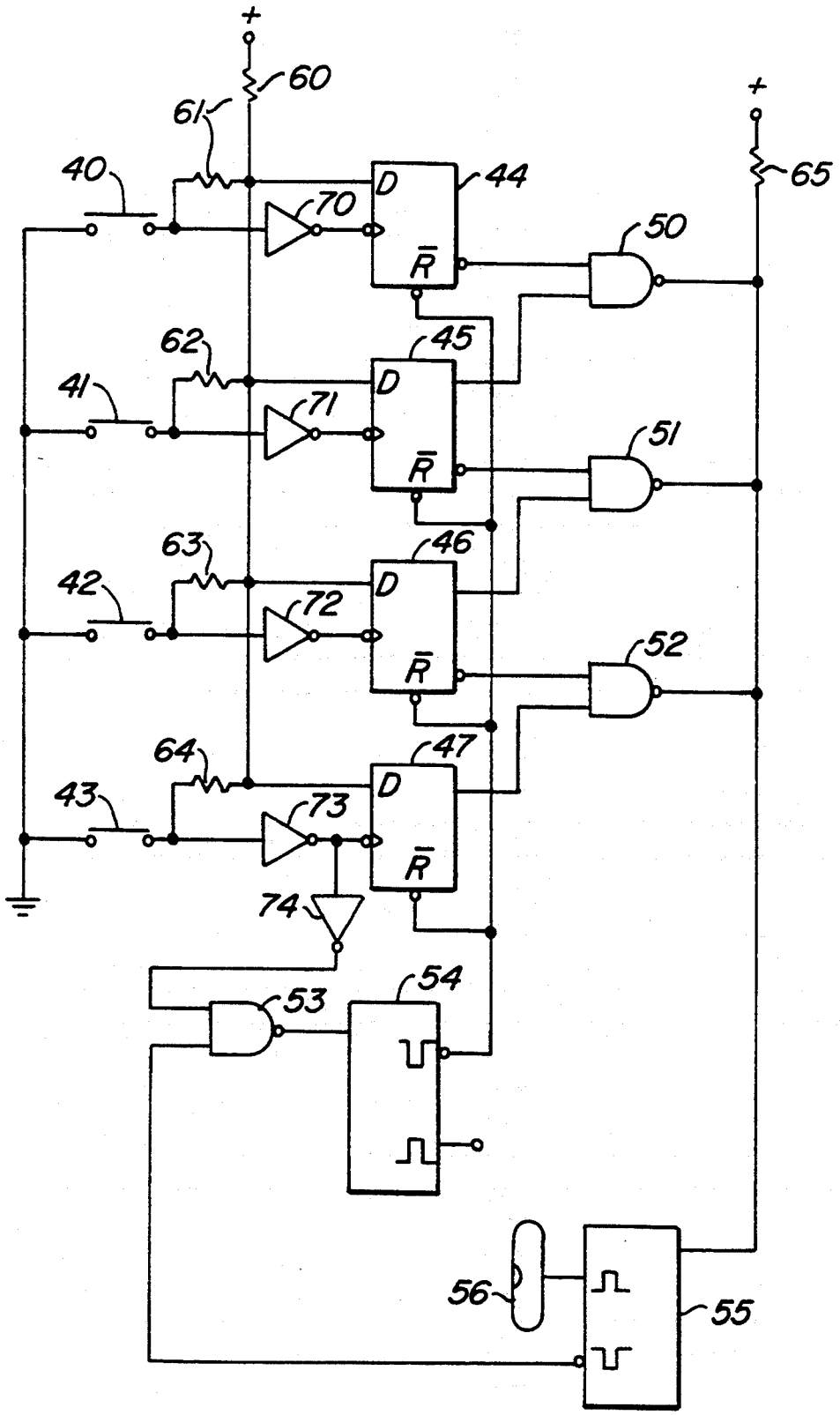
FIG. 8 is a schematic diagram of the circuit used in the second embodiment of the present invention, shown in FIG. 6.

In accordance with the foregoing, FIGS. 6, 7, and 8, show views of a sport shoe incorporating the present invention. FIG. 6 shows an athletic shoe generally referred to as 30. The shoe is of the type commonly known and consists of lower sole 31, a body consisting of upper shell 32, laces 33, tongue 34, and footbed insert 35, which is shown by the elevated view.

Incorporated into the footbed insert of the shoe is a pattern of several pressure switches 40 to 43 such as are commonly known in the art. These switches are formed of two pieces of flexible metal laid on top of one another, but electrically insulated from one another until pressure is applied. Their most common use is in the manufacture of pressure pads used in alarm systems. FIG. 6 shows a top view of the footbed sensing device insert 35 of the shoe depicted in FIG. 6. In this view, the layout of pressure switches 40 to 43 is clearly shown and are labeled as such. While other layout schemes are possible, such as a transverse, rather than a longitudinal orientation, this pattern is exemplary of one which can be used to achieve the desired result.

A common gait is characterized at heel strike on the support surface 36 by pressure beginning near the heel of the shoe, and continuing around the outside of the toe. According to the location of labeled pressure switches shown in FIG. 7, a common gait would result in activation of the pressure switches in the order 40, 41, 42, 43. Excessive pronation and other problems in gait would result in a different pattern of activation of the pressure switches.

In FIG. 8 is shown a simple logic circuit which is used to decode the electrical pattern produced by the activation of the pressure switches described. The circuit consists of pressure switches labeled 40, 41, 42, and 43, which are equivalent to those seen in FIG. 7; d-type latches labeled 44, 45, 46, and 47; NAND gates labeled 50, 51, 52, and 53; inverters labeled 70, 71, 72, 73, and 74; monostable latches 54 and 55; piezoelectric alarm 56; and pull up resistors 60–65. The logic of the circuit shown is such that the alarm will sound for a brief moment if the switches are not activated in the proper sequence. This can be an indication of an improper gait. The proper sequence of the switches of FIG. 7 is 40, 41, 42, and 43. Switch 40 must be activated before Switch 41, Switch 41 must be activated before Switch 42, and Switch 42 must be activated before Switch 43. Any other sequence results in an alarm.

Since other configurations and logic for detecting various gait related problems will occur to those skilled in the art, the circuit of the present invention is given as an example of the types of devices which may be constructed. This disclosure is therefore not limited by the specific embodiment described.

In the third embodiment of the present invention, the device is applied to the improvement of the golf swing. The dynamics and low tolerance for error of the golf swing make it one of the most technically difficult sports maneuvers to master. Many of the master golfers make use of high speed photography to indicate flaws in their stroke technique. This type of feedback helps them to improve their performance. This complex and expensive equipment is not available to most golfers. However, one can conceive of a simple and inexpensive device which readily attaches to a golf club and provides feedback to the player that is useful for improving golf technique.

Figure 9:
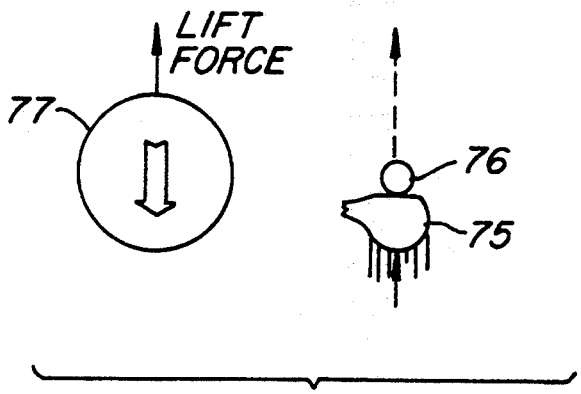
FIGS. 9–11 are top views of a series of instructional drawings showing the dynamics of a golf swing and its effect on the golf ball.
Figure 10:
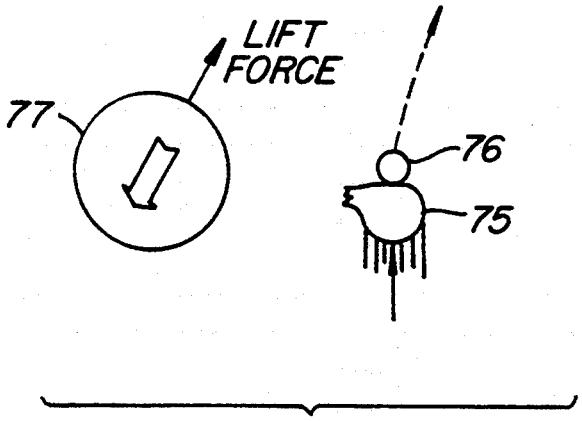
Figure 11:
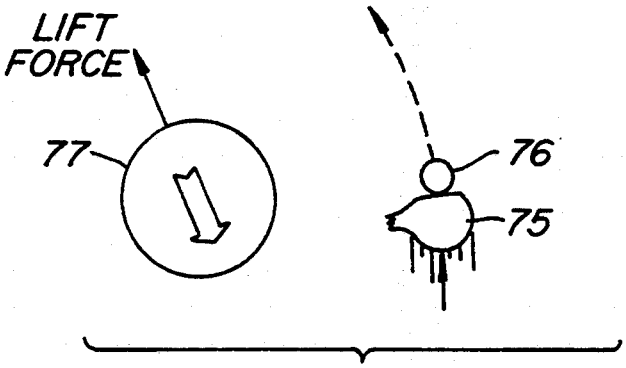

In accordance with the foregoing, refer to FIGS. 9 through 15. FIGS. 9, 10, and 11 show three views, which represent straight, slice, and hook shots respectively. Each view shows a club 75, in relative motion toward a golf ball 76, which is projected by the force of the club in the direction shown. Each view also includes a diagrammatic representation 77 of the spin and lift forces on the golf ball which cause it to project in a specific direction. The slice and hook shots are caused by a slight angle between the club and ball at the point of impact giving the ball an angular spin and curved path. Many analyses of the golf swing have shown that this angle need be only within a few degrees for the shot to be inaccurate.

Figure 12:
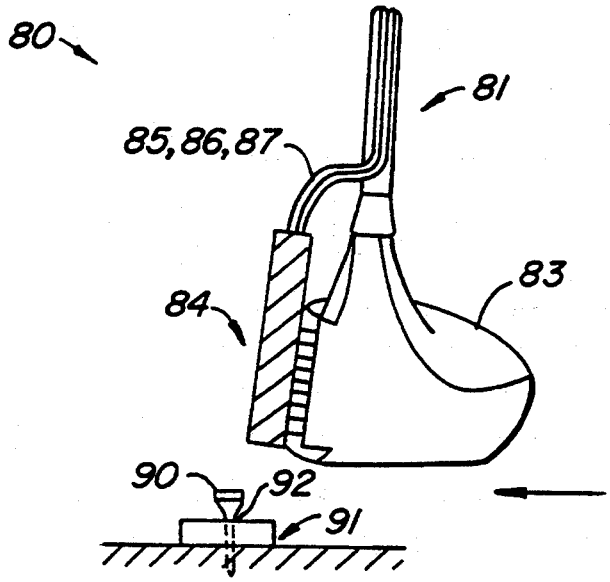
FIG. 12 is a view of the golf club and tee shown in FIGS. 9–11, with a third embodiment of the device of the present invention installed.
Figure 13:
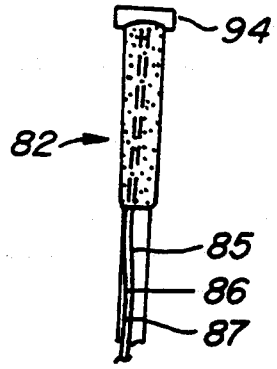
FIG. 13 is a side view of the handle of the golf club shown in FIGS. 9–11, with sensor wires in place.

FIGS. 12 and 13 show a golf club 80, consisting of stem 81, handle 82 and head 83. A magnetic sensing device 84 is shown attached to the leading edge of the head of the club, although other positions on the club are equally conceivable. Sensing device 84 is connected by small wires 85, 86, and 87, which pass up the stem and under handle 82 to circuit 94 fixed to handle 82. FIG. 12 also shows a golf tee 90 and a disc shaped permanent magnet 91 with a hole 92 through which the golf tee 90 may pass such that the golf tee 90 may be placed in the ground as is customary during a "tee-off". During a normal golf swing, golf club head 83 passes by the magnet 91. This interaction results in a small electrical current in the magnetic sensing device 84.

Figure 14:
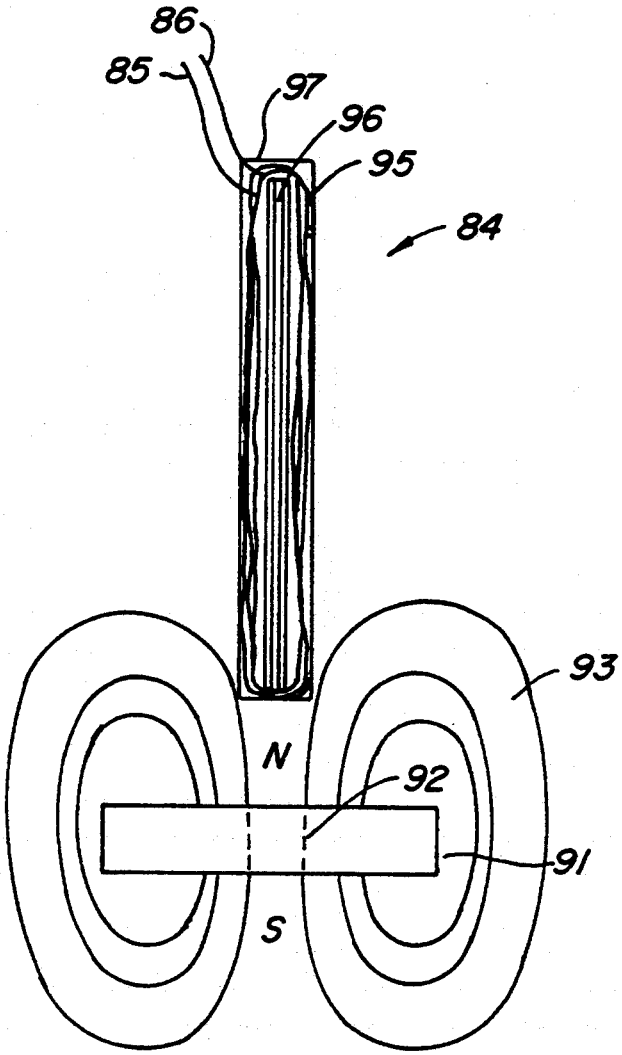
FIG. 14 is an enlarged view of the device of FIG. 12, showing more clearly the composition of the magnetic sensor, and the orientation of the magnet.

As shown in FIG. 14, sensing device 84 consists of two wire coils 95 and 96 respectively, wound on a coil form 97. The plane of each coil is positioned on the coil form such that it is perpendicular to the plane of the other coil as shown. Furthermore, sensing device 84 is positioned on the golf club such that the plane of coil 96 is parallel to the ideal direction of motion of the golf club during a perfect shot.

Magnet 91 is also shown in the enlarged view of FIG. 14. The magnet is of the type and polarity such that one pole points upward toward the club and the other points downward toward the ground when it is placed in the position shown in FIG. 12. In FIG. 14, the magnet is labeled as such by the designator N and S, and magnetic lines of force 93 have been drawn for clarity.

As stated, sensing device 84 passes through and interacts with magnet 91 of the magnetic field during the golf swing. Since the coils of sensing device 84 are perpendicular, a proportionally larger signal will be generated in one coil relative to the other. If the swing is absolutely perfect, the difference in the two signals will be the greatest since the signal in coil 96 is great relative to the signal in coil 95 which is small. If the swing is off by a certain angle, the difference between the two signals will be proportionally less since the signal in coil 96 will be less than it was while signal in coil 95 will be greater than it was with the perfect shot. Larger angles of deviation result in less difference in signal between the two coils.

Figure 15:
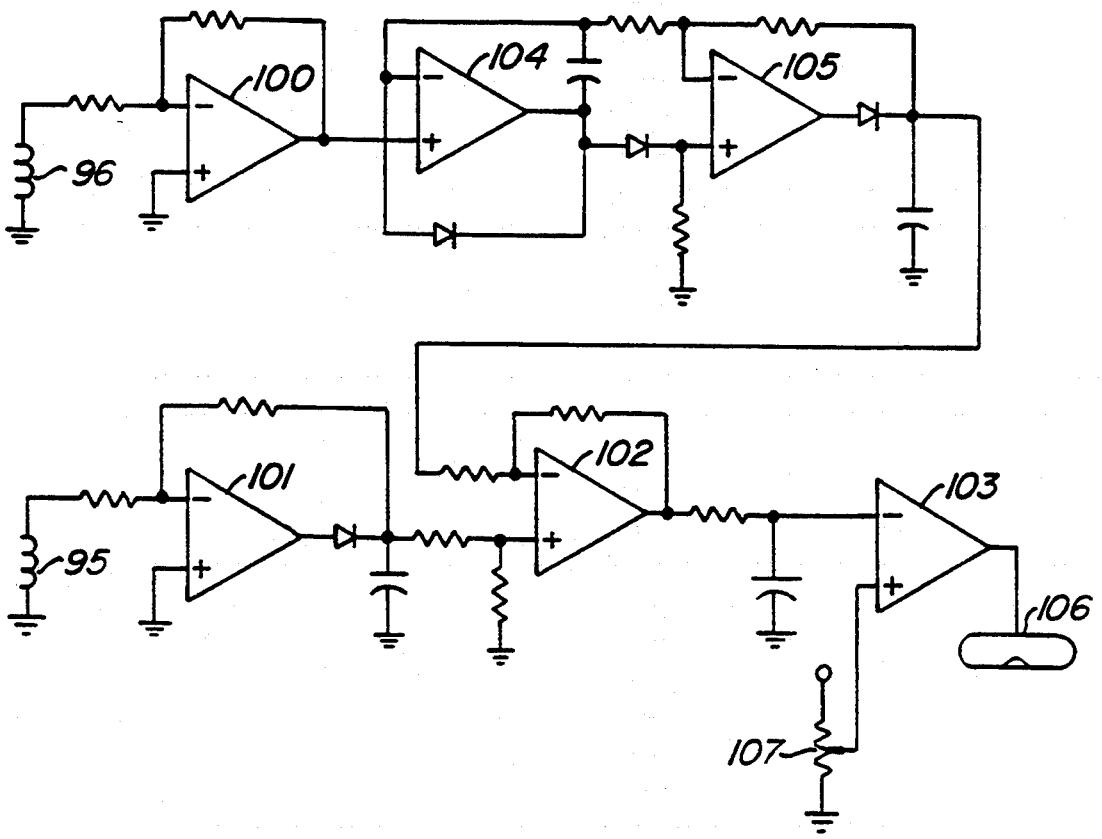
FIG. 15 is a schematic diagram of the circuit used in the third embodiment of the present invention shown in FIGS. 12–14.

The signal from the two coils are routed to circuit 94 by means of small wires. FIG. 15 shows a schematic diagram of the entire circuit. As shown, signals from coils 95 and 96 are directed into preamplifiers 100 and 101. Rectifiers 104 and 105 provide the absolute value of the output of preamplifier 100. Differential amplifier 102 compares the signals, and threshold comparator 103 detects if the difference is above a preset level determined by variable resistor 107. If so, a signal is sent to piezoelectric buzzer 106 which has a feature allowing it to sound for a brief moment after the golf swing and then stop. The various resistors, capacitors, and diodes shown in the circuit are common to circuits of this type and their values are such that signal levels are kept within acceptable limits for the circuit to function as it should. Each of the six amplifiers 100, 101, 102, 103, 104 and 105 may be of the CMOS variety known in the art for low power consumption and small size. As such, the circuit of FIG. 15 may be built quite compactly into the handle of a golf club or into a unit which adds on to a golf club without inconvenience to the player. Furthermore, the circuit can be powered for extended periods with only a small battery.

The applicant can envision many enhancements to the present circuit to allow it to detect whether the angle between the club and the ball is open or closed, and by how much. A display device may be added to the circuit to indicate to the player how many degrees the swing is off. A further advantage of this embodiment is that the player does not have to be engaged in actually hitting balls to practice his swing. The device will detect a bad swing without a ball being present.

The present invention also relates to a sport shoe pressure shift signaling device and more specifically, to a device for indicating pressure shift within an alpine ski boot during the turning phase of skiing.

A ski is often turned relative to a snowy slope using a carved turn, by side slipping the tail, or by a combination of both maneuvers. Comparing both maneuvers, carved turns in both racing and recreational skiing are most efficient, while side slipping the tail of a ski is characterized by a frequently undesirable dissipation of energy.

To properly execute a carved turn, a ski must be rolled on edge with sufficient pressure to bend it toward reverse camber. To be sufficient, the arc of the reverse camber must be essentially equal to the arc of the turn. Consequently, the sharper the turn, the greater is the pressure required.

Generally, the pressure required for a carved turn is applied of a ski and snowy slope using either forward leverage, neutral leverage or backward leverage, depending on the condition and the performance desired. Forward leverage is applied to the ski by a skier shifting his weight toward the tip of the ski and applying forward pressure thereto. Backward leverage is applied to the ski by a skier shifting his weight toward the tail of the ski and applying rearward pressure thereto.

Most carved turns are initiated with forward leverage against the snowy slope to increase control of the ski tip. Forward leverage places the most severe part of the reverse camber toward the tip of the ski. However, if forward leverage is maintained throughout a turn, the tip acts as a brake and causes excessive chatter. For this reason, as soon as the tip establishes the desired arc of the turn, the pressure on the ski is typically moved to the center of the ski or to a position of neutral leverage. Neutral leverage flexes the ski on a nearly smooth arc. Consequently, sustained turns are best made with neutral leverage.

Rearward leverage moves the sharpest bend of reverse camber toward the tail of a ski. However, sustained turns generally cannot be carved with rearward leverage because the ski side cut is less severe in the rear half of the ski than in the front half. Consequently, rearward leverage is best used for long radius turns on relatively flat terrain or soft snow, although on steeper terrain, turns are often ended with rearward leverage to provide acceleration. Notably, a most important use of rearward leverage is to complete with carving action, all turns that are initiated by steering a relatively flat ski.

During normal skiing, most of the skier's weight is located at the center of a ski. However, during a turn, subtle changes in leverage will distribute the skier's weight sufficiently ahead or behind the waist of the ski to carve a turn on the forward or rearward portion of the ski. Because of this characteristic of skis, carving the tip of the ski requires only moving the balance position slightly ahead of the waist of the ski. Likewise, carving the tail of a ski requires only a slight rearward balance adjustment.

Considering the foregoing description, one can envision a device which provides an indication to the skier of the pressure exerted by the foot in the boot during a carved turn maneuver. Since the timing of the changed camber of the ski during a carved turn is critical, such a device can provide information which the skier would use to improve technique.

The brain uses all available sensory information which it interprets at the conscious and subconscious level to regulate body motion. Body motion on the object of the action in turn creates more sensory information. This feedback loop forms what we call learning since it eventually creates a program which is memorized by the brain and used in future similar maneuvers. The more developed this program is in a person, the more experience we say he has. It follows that enhancing any portion of this feedback loop will enhance the learning process.

Figure 16:
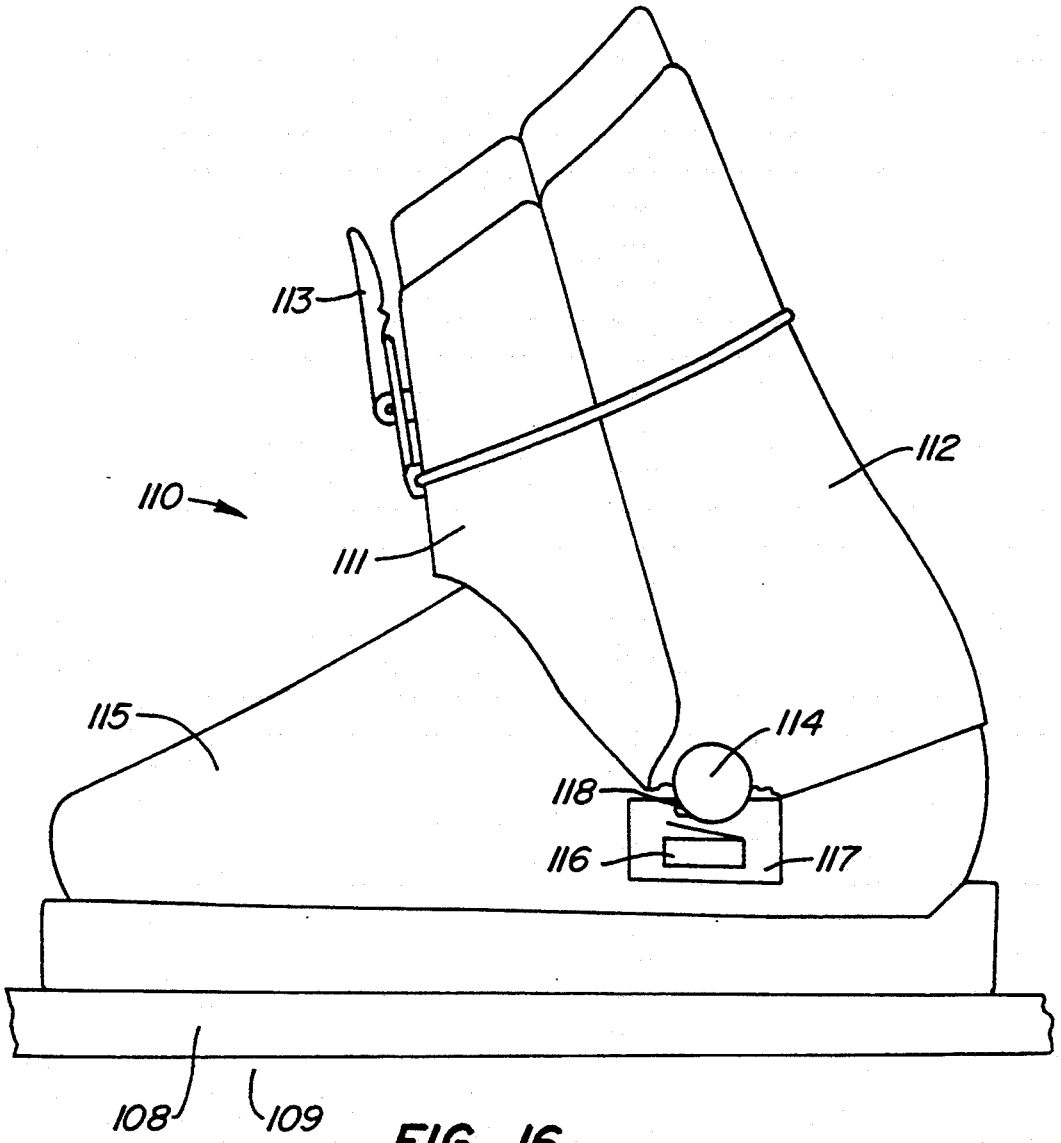
FIG. 16 is a side elevational view of a ski boot showing a microswitch$^R$ and cam used in the fourth embodiment of the present invention.
Figure 17:
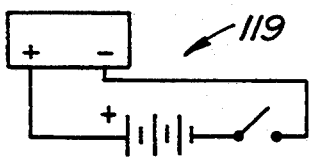
FIG. 17 is a schematic diagram of the circuit and battery for sounding an alarm used in the fourth embodiment of the present invention.
Figure 18:
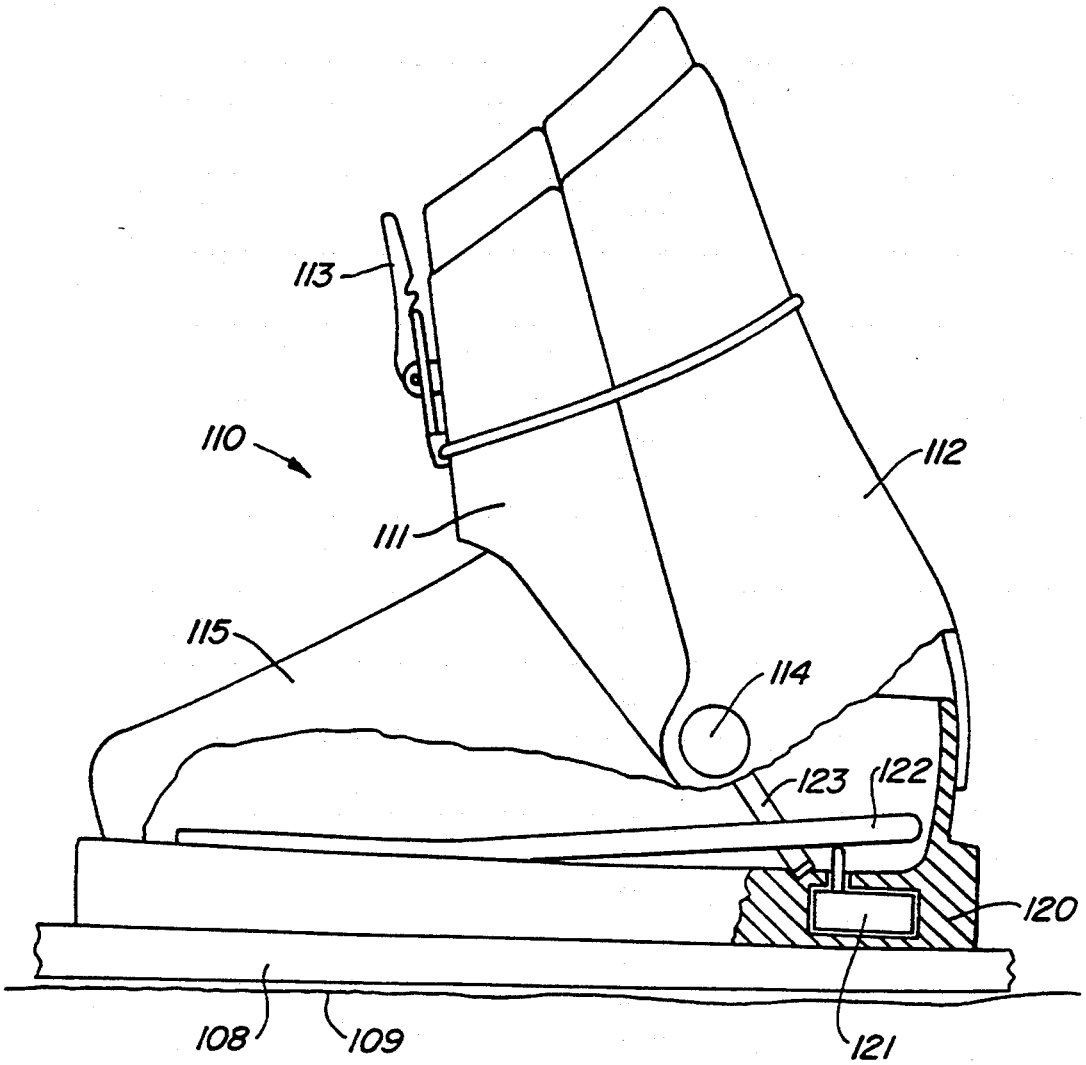
FIG. 18 is a side elevational view of the ski boot shown in FIG. 16, showing an alternative form of the fourth embodiment of the present invention.

The invention as it relates to snow skiing is shown in FIGS. 16, 17 and 18. These figures include a ski 108, a snowy slope 109, a ski boot shown generally as 110, secured to the ski by a ski binding, known per se, front cuff 111, rear cuff 112, buckle 113, pivot point 114, and lower shell 115.

In FIG. 16, a sensing device switch 116 is provided in a recess 117 located near pivot point 114 of the boot front cuff 111, rear cuff 112 and lower shell 115. Recess 117 would normally have a cover over it to protect the switch, however, it is shown here without a cover for clarity of explanation. In this embodiment, pivot 114 is fixed to rotate front cuff 111 and rear cuff 112 relative to the lower shell 115 ski 108 and snowy slope 109. Pivot 114 also has a small cam 118 located in the proximity of switch 116 such that when a predetermined amount of forward lean relative to the snowy slope 109 is present in the front cuff, switch 116 is activated. Switch 116 then activates a battery and an alarm circuit 119 shown in FIG. 17. The battery and alarm circuit may be housed in the same compartment as the switch, or in the heel of the boot or other convenient location such as the ski jacket collar. A wireless alarm circuit, known per se, can be incorporated in the device so that a remote alarm is located in or near the skier's ear. In this configuration, the alarm indicates to the user that the proper forward lean has been achieved for a normal carved turn.

A person skilled in the art would note that a second cam can be added to pivot 114 to activate the same switch during rearward lean. The alarm would then also indicate sufficient rearward lean to properly recover from a normal carved turn. It should also be noted that a provision can be made to adjust the location of the switch thereby changing the point at which it will activate. This would be an advantage to skiers who practice different types of turns such as recreational skiing versus competitive slalom skiing.

FIG. 18 is an alternate embodiment of the invention disclosed in FIG. 16. In FIG. 18, a ski boot 110 includes a switch 121 located in the heel 120 of the boot. The elevational view also shows a moving footbed 122 which is acted upon by yoke 123. When sufficient forward lean is applied to the front cuff 111, the yoke 123 causes footbed 122 to move upwardly and to release switch 121. Switch 121 may be of the normally closed type such that it is activated when it is released. As in FIG. 16, switch 121 activates a battery and circuit not shown for sounding a signal or an alarm.

It is understood that the concept of this invention can readily be applied in various embodiments to sports equipment not described herein by someone knowledgeable in the art. It is further understood that this invention is not limited to the embodiments described herein. The scope of the invention is limited only by the following claims.

What claimed is:

1. A self-contained, electronic device for providing operational feedback to a player of how he uses a sports equipment comprising:

a shoe having a heel area and a toe area;

first means for sensing a force applied by a player to the heel area of the shoe;

second means for sensing a force applied by the player to the toe area of the shoe;

third means for sensing a force applied by the player to the heel area of the shoe, the third sensing means being positioned toward an instep side of the shoe with respect to the first sensing means;

fourth means for sensing a force applied by the player to the toe area of the shoe, the fourth sensing means being positioned toward the instep side of the shoe with respect to the second sensing means;

means, coupled to the first, second, third and fourth sensing means, for determining whether the sensing means are activated in a predetermined order, wherein said predetermined order of activation is in the order of said first sensing means, said third sensing means, said second sensing means, and said fourth sensing means; and alarm means operatively coupled to the determining means for indicating to the player when said sensing means are activated not in said predetermined order.

* * * * *